United States Patent [19]

Oh

[11] Patent Number: 4,970,359

[45] Date of Patent: Nov. 13, 1990

[54] AUTOMATIC COOKING CONTROL SYSTEMS FOR A MICROWAVE OVEN

[76] Inventor: Ki Tae Oh, 391-6, Kaeumjeong-Dong, Changwon, Kyungsangnam, Rep. of Korea

[21] Appl. No.: 250,445

[22] Filed: Sep. 28, 1988

[30] Foreign Application Priority Data

Sep. 30, 1987 [KR] Rep. of Korea ..... 10984/1987
Dec. 22, 1987 [KR] Rep. of Korea ..... 14743/1987

[51] Int. Cl.[5] ..... H05B 6/68

[52] U.S. Cl. ..... 219/10.55 M; 219/10.55 B; 219/10.55 E; 99/325

[58] Field of Search ..... 219/10.55 M, 10.55 B, 219/10.55 E; 99/DIG. 14, 451, 325; 426/241, 243

[56] References Cited

U.S. PATENT DOCUMENTS 4,115,678 9/1978 Tachikawa et al. ..... 219/10.55 B
4,162,981 7/1979 Buck ..... 219/10.55 B
4,812,606 5/1989 Eke ..... 219/10.55 B
4,831,227 5/1989 Eke ..... 219/10.55 M

*Primary Examiner*—Philip H. Leung

[57] ABSTRACT

An automatic cooking control system for a microwave over which utilizes a microcomputer for controlling the whole operation of a microwave oven. An electric power source and magnetron are used for generating microwave energy. Fans are disposed at an air inlet and an air outlet of a heating chamber. The air temperature of inflow and outflow are detected and converted by analog/digital converters into the digital signals. The system performs an initial operation process, first stage heating process, and second stage heating process to complete a full automatic cooking process. The system performs calculations to determine the parameters to be used in second stage heating process according to a temperature variation in ambient air around a microwave oven. This change could be due to the change in season or even a change during the operation of the microwave oven. This results in optimum cooking without regard to the temperature variation in ambient air around a microwave oven.

12 Claims, 9 Drawing Sheets

FIG, 1
PRIOR ART
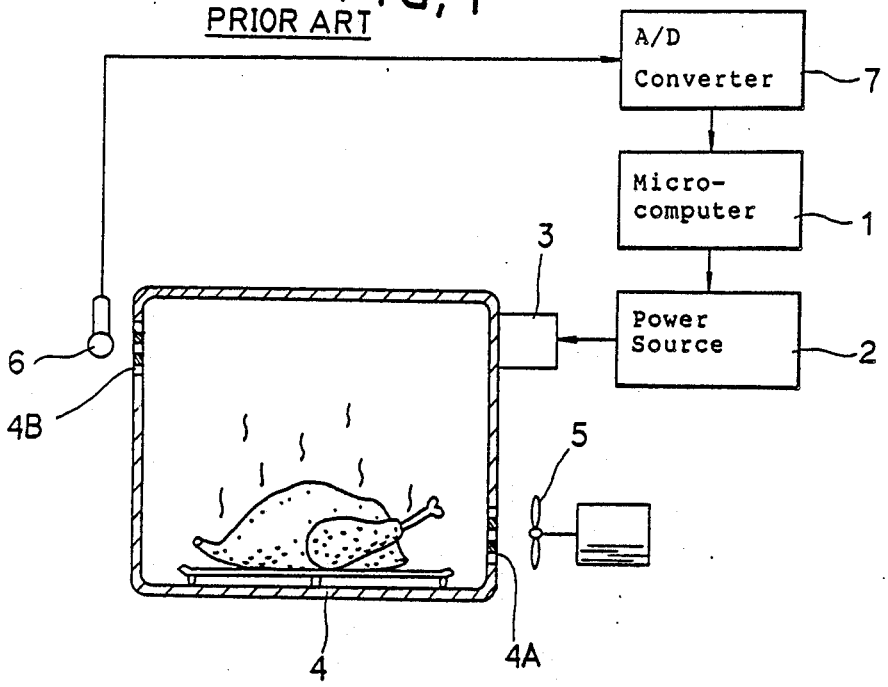
FIG, 3
PRIOR ART
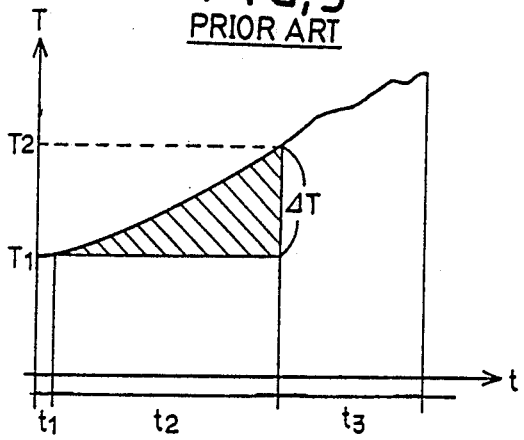

FIG, 2
PRIOR ART
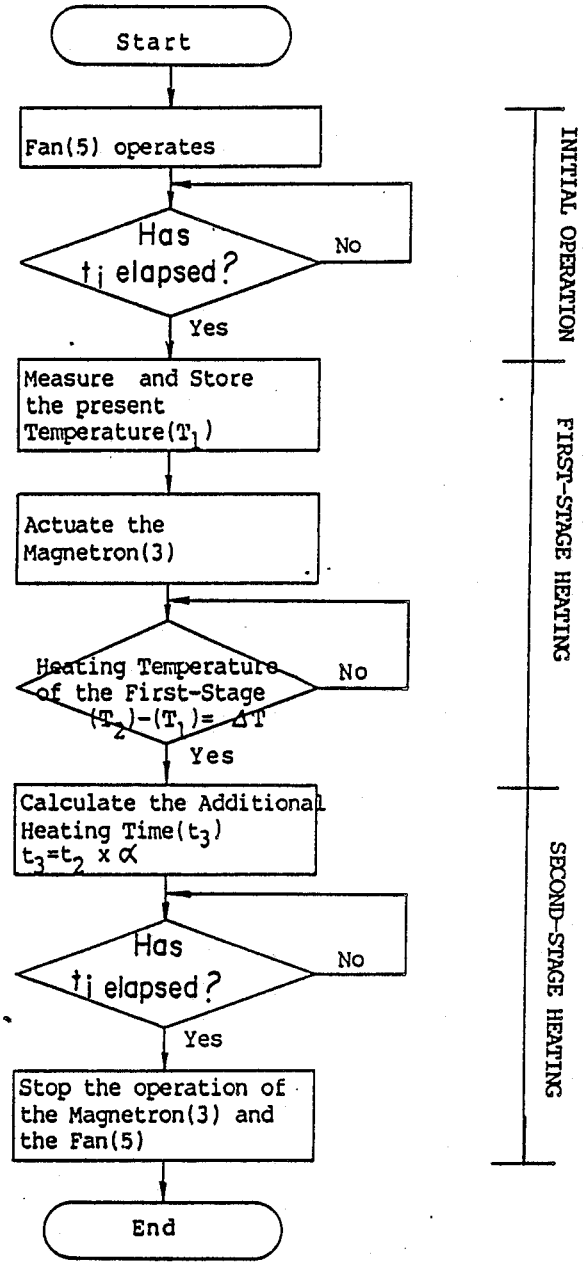

FIG, 4A
PRIOR ART
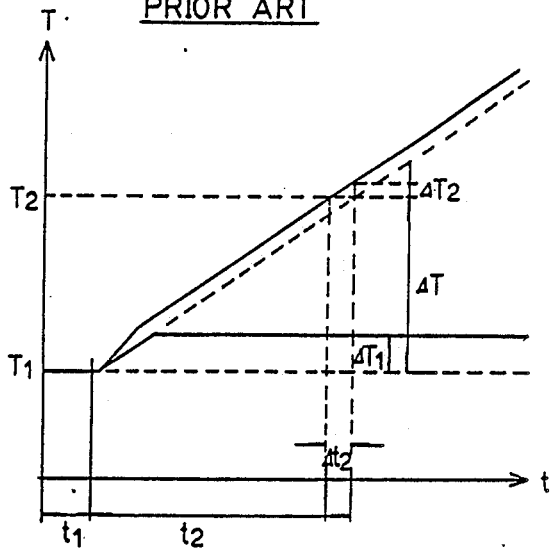
FIG, 4B
PRIOR ART
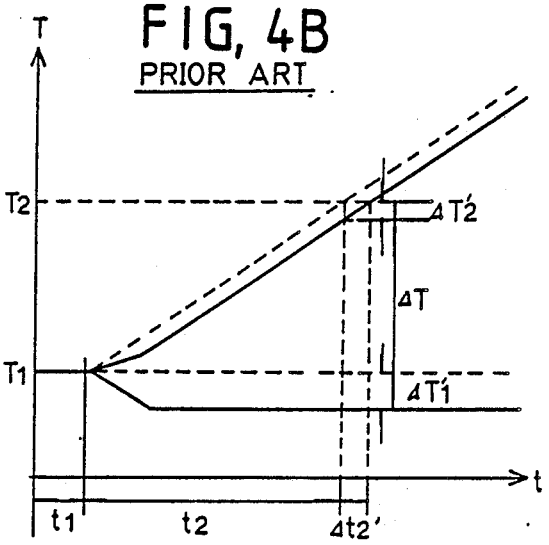

FIG, 5A
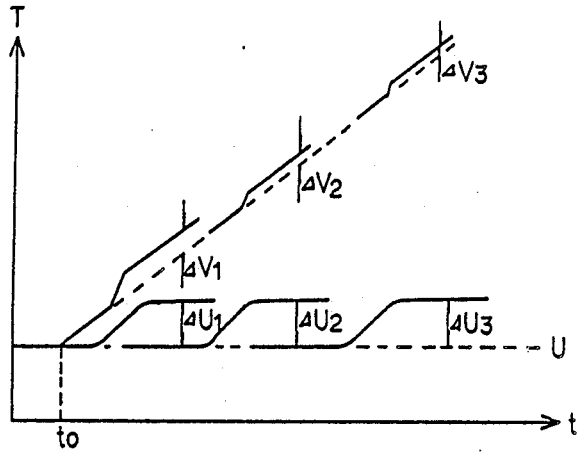
FIG, 5B
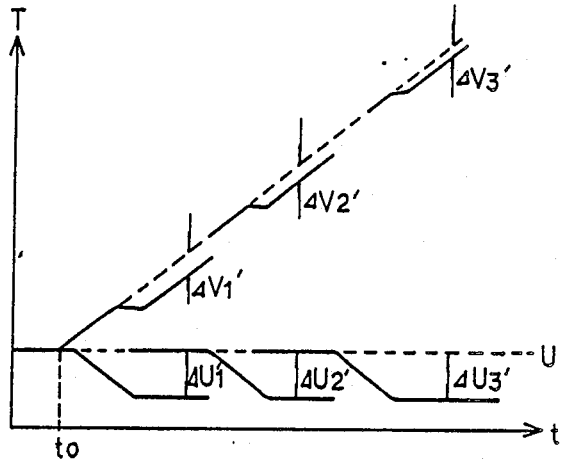

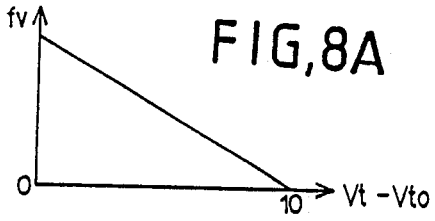
FIG,8A
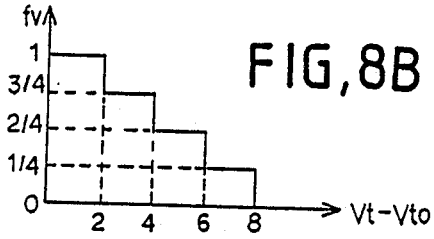
FIG,8B
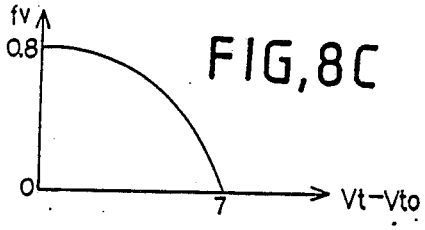
FIG,8C
FIG,9
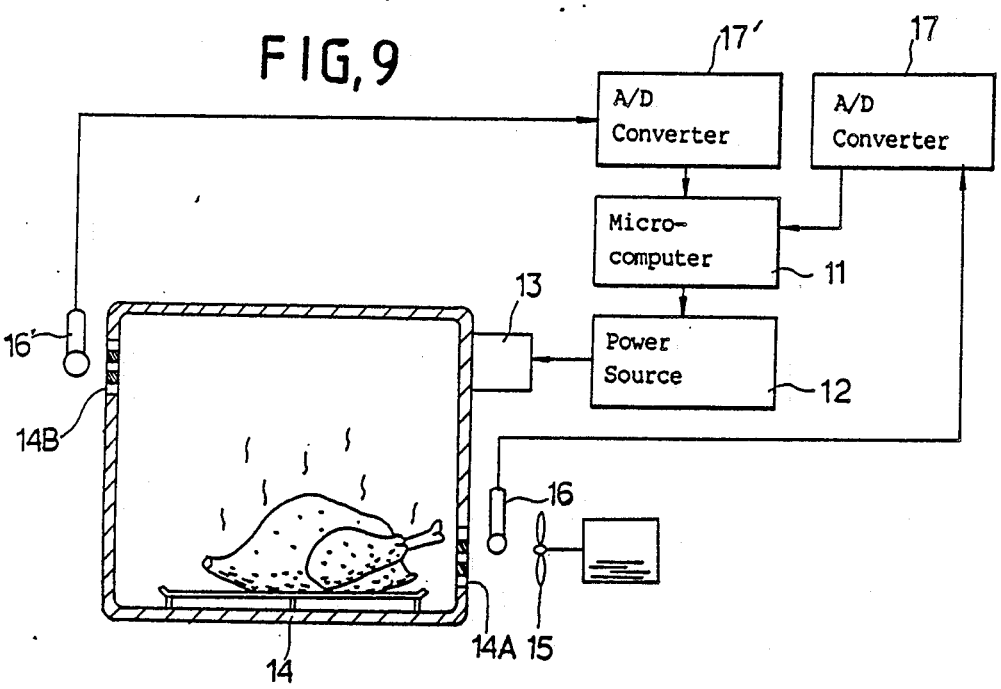

FIG, 10
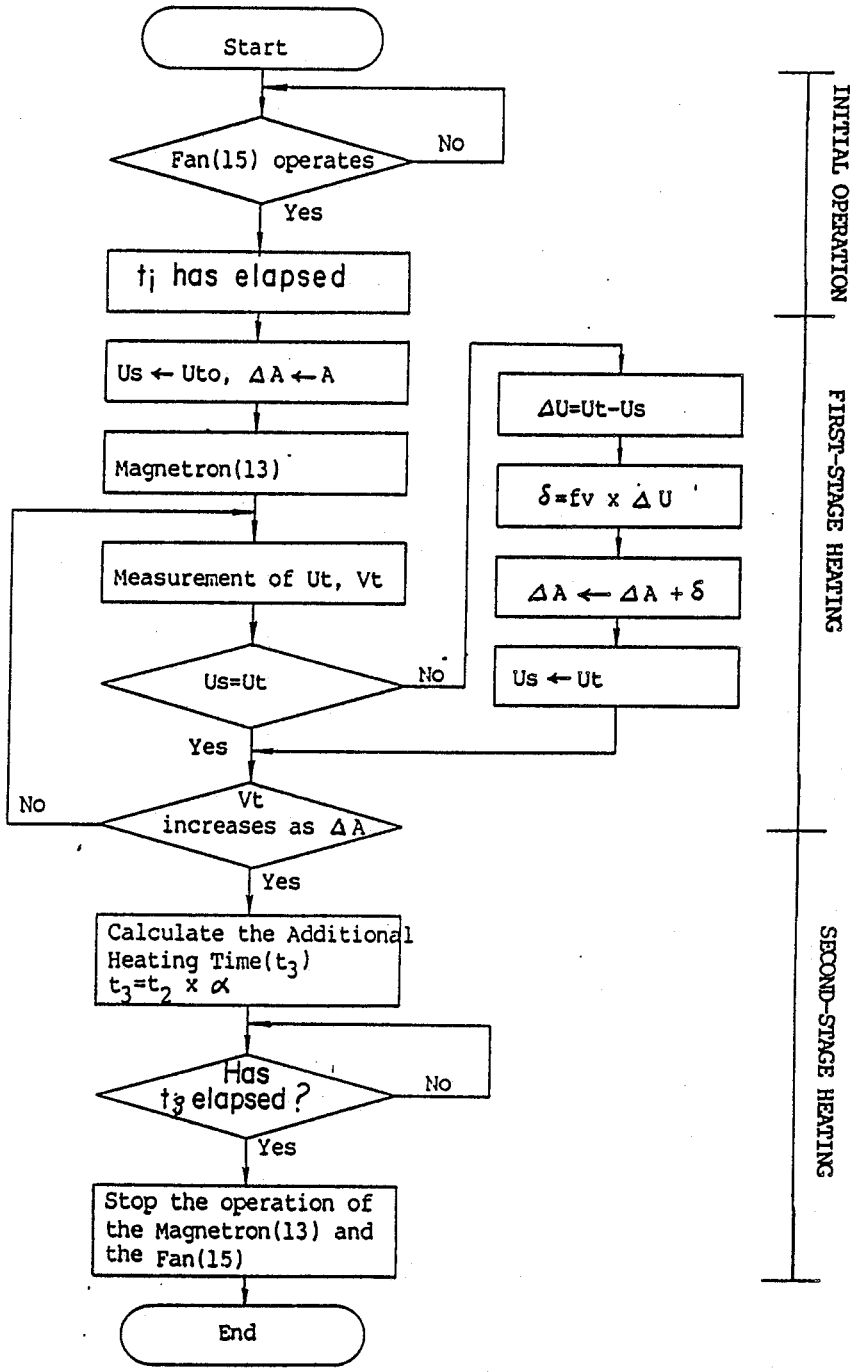

FIG, 11
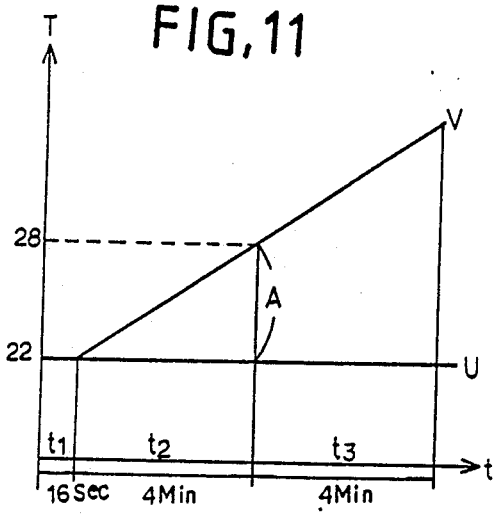
FIG, 12
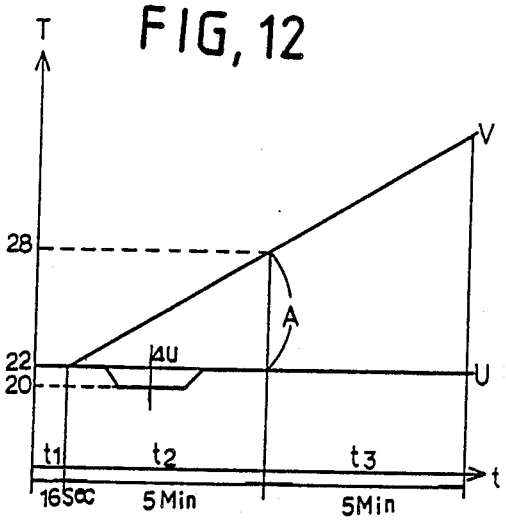
FIG, 13
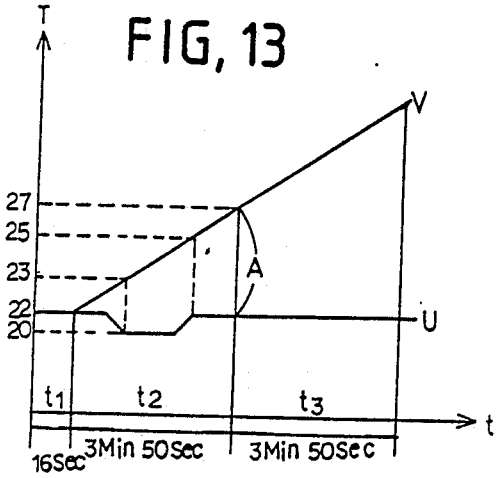
FIG, 14
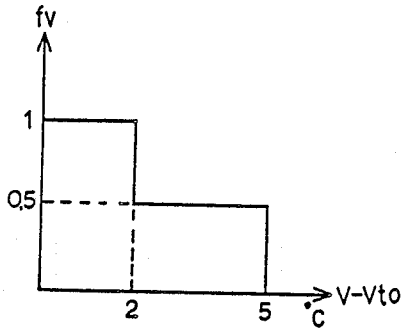

FIG, 15
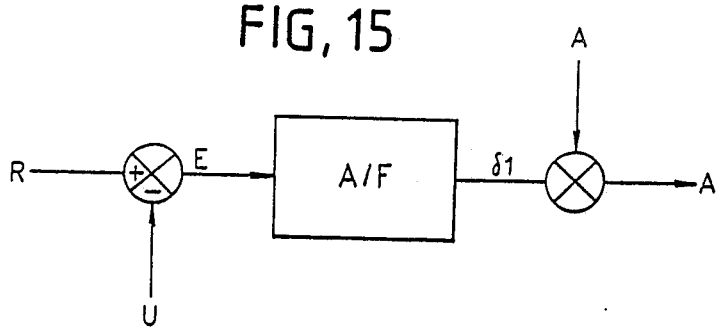
FIG, 16
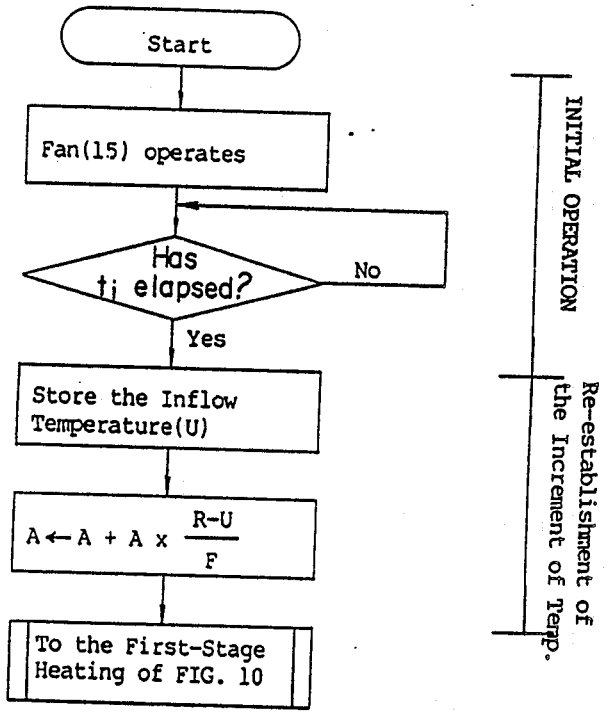

AUTOMATIC COOKING CONTROL SYSTEMS FOR A MICROWAVE OVEN

BACKGROUND OF THE INVENTION

The present invention relates to an automatic cooking control system for a microwave oven which automatically cooks foods contained in a heating chamber by utilizing a temperature sensor. More specifically, the present invention relates to an automatic cooking control system for a microwave oven which allows cooking of foods by correctly establishing the heating period of time of the foods even when the temperature of the incoming air, flowing into a heating chamber via a fan, is varied due to the ambient temperature around the microwave being raised or lowered.

A conventional microwave oven, as shown in FIG. 1, is constructed with a microcomputer 1 which controls the whole operation of a microwave oven; a power source 2 which supplies electric power source according to the control of magnetron 3 which generates microwave energy according to the output power from the power source 2; a heating chamber 4 which heats the foods with the microwave energy generated from the magnetron 3; a fan 5 which causes air to flow through an air inlet 4A of the heating chamber 4; a temperature detecting sensor 6 which detects the temperature of the air flowing through an air outlet 4B of the heating chamber 4; and an analog/digital converter 7 which receives the temperature signal of the outflow air detected by the temperature detecting sensor 6 and converts the signal into a digital signal.

Conventional microwave oven as described above, a user begins the cooking process by putting the foods to be cooked into the heating chamber 4 and and then presses a buttom to start the cooking, as shown in FIGS. 2 and 3. A microcomputer 11 then performs an initial operation for a certain period of time $t_1$. During this initial operation, the air temperature within the heating chamber 4 is caused to become uniformly balanced with the air flowing through the air inlet 4A into a heating chamber 4 by actuating the fan 5 for about 16 seconds. At this moment, the temperature of the air flowing through the air outlet 4B of the heating chamber 4 is detected by the temperature detecting sensor 6 from. The detected temperature signal is converted into digital signals by an analog/digital converter 7 to produced an output.

When a certain period of time elapses under this condition the microcomputer 1 stores the signal of the present temperature $T_1$ received from the analog/digital converter 7 and utilizes this signal to control the electric power source 2 which actuates the magnetron 3. When the magnetron 3 is actuated, the magnetron 3 generates microwave energy which heats up the food contained in the heating chamber 4 since the temperature of the air flowing out of the air outlet 4B of the heating chamber 4 is raised gradually raised according to the heating of the food, the detected temperature signal which is detected by the temperature detecting sensor 6 gradually becomes raised.

When an increment of temperature, which is caused under these condition, reaches a certain temperature value $\Delta T$, i.e., if the increment of the temperature becomes a certain temperature value $\Delta T$ due to the temperature detected by the temperature detecting sensor 6 is raised to a certain temperature $T_2$, the microcomputer 1 finishes a first step of the heating process and begins to execute a second step of heating the process. That a period of time $t_2$ realized during the first heating stage is stored, then a constant value $\alpha$ established in accordance with the kind of food being cooked is multiplied by the period of time $t_2'$ thereby calculating a period of time $t_3$ to be used during the second heating stage calculated, and. The food is heated by continuously actuating the magnetron 3 during the period of time $t_3$. When the heating stage period of time $t_3$ has elapsed, the operation magnetron 3 and of the fan 5 are scopped, and the cooking of the food is completed.

However, in such a conventional automatic cook control system as described above, the automatic cooking of foods could not be precisely performed because when the temperature of the air flowing into a heating chamber 4 is varied due to the ambient temperature around the microwave oven during the performing of the first heating stage, the temperature detected by the temperature detecting sensor 6 also varied in accordance with the variation of the temperature.

As shown in FIG. 4A, if the temperature of the air that the fan 5 blows into the heating chamber 4 is raised, according to the rise in the external temperature, as much as a temperature value $\Delta T1$ during the first heating stage the temperature detected at the temperature detecting sensor 6 rises as much as an amount of a certain temperature value $\Delta T2$ in accordance with the rise of the temperature. Accordingly the period of time $t_2$ realized during the first heating stage in advanced by a certain period of time $\Delta t_2$; therefore, the cooking of the food is not completely finished. Further as shown in FIG. 4B, if the temperature of the air that the fan 5 blows into the heating chamber 4 drops as much as a certain amount of temperature value $\Delta T'_1$ in accordance with a drop in the ambient temperature, the temperature which is detected by the temperature detecting sensor 6 down as much as a certain amount of temperature value $\Delta T'_2$. Accordingly, the period of time $t_2$ realized during the first heating stage is delayed by a certain period of time $\Delta t'_2$; therefore, the automatic cooking causes over cooking of the foods.

In addition, in the conventional automatic cooking method described above, an error occurs when establishing a heating period of time in accordance with the ambient temperature around the microwave oven due to the variation in the seasons. Even though same kind, and amount of food is heated, when the ambient temperature is a temperature representative of spring or autumn, a constant temperature varying charateristic is obtained. While when the ambient temperature is representative of summer, the temperature increasing rate becomes nonexistent when compared to the rate in spring or autumn, and when the ambient temperature is low as in winter, temperature increasing rate is higher than in spring or autumn. As a result, if a predetermined constant temperature increment $\Delta T$ is established of time the heating period of time of the foods is incorrectly established in accordance with the ambient temperature around the microwave oven due to the variation in the seasons; therefore, there has been also the defectiveness the food is either overcooked or undercooked.

SUMMARY OF THE INVENTION

Therefore, an object of the present invention is to provide an automatic cooking control system for a microwave oven which permits the performing of the automatic cooking of foods to be optimum by correctly establishing the temperature increment of the out flow air even if the inflow air temperature coming into a heating chamber is varied due to the ambient temperature around the microwave oven being varied during the first heating stage of the microwave oven.

Another object of the present invention is to provide an automatic cooking control system for a microwave oven which permits the performing of the automatic cooking of foods to be optimum by compensating the temperature increment depending upon the basis of a predetermined temperature even if the ambient temperature is varied in accordance with the change in season.

The objects of the present invention as described above are accomplished by correctly establishing the temperature increment of the out flow air during the first heating stage depending upon the predetermined specific temperature in accordance with variation of season. If an ambient temperature rises higher than the specific temperature, the temperature increment is established at a lower value using an inverse proportion. If an ambient temperature is lower than the specific temperature, the temperature increment is established at a higher value using an inverse proportion. If the temperature of an ambient air flowing into the heating chamber during the condition of first heating stage is raised or dropped, the temperature increment flowing out of the heating chamber during the first heating stage is compensated for differently according to the rise or fall of the temperature.

BRIEF DESCRIPTION OF THE DRAWINGS

FIG. 1 is a schematic diagram of the configuration of a conventional microwave oven.

FIG. 2 is a signal flow chart of a microcomputer used in a conventional microwave oven of FIG. 1.

FIG. 3 is a graph illustrating the temperature variation according to the operation of the conventional microwave oven of FIG. 1.

FIG. 4A shows a graph illustrating the operation of a conventional microwave oven. when the temperature is rising.

FIG. 4B shows a graph illustrating the operation of a conventional microwave oven when the temperature is dropping.

FIG. 5A is a graph showing the effect of the temperature rising.

FIG. 5B is a graph showing the effect of the temperature dropping.

FIGS. 8A to 8C are graphs showing curves of various functions applied to the present invention.

FIG. 9 shows a schematic diagram illustrating a configuration of a microwave oven of the present invention.

FIG. 10 is a signal flow chart of a microcomputer according to the present invention.

FIG. 11 to FIG. 13 are graphs showing the results that a cabbage being cooked according to the conventional and the present invention.

FIG. 14 is a graph showing a gradient applied to FIG. 13.

FIG. 15 is a block diagram showing a principle for establishing the temperature increment according to the change in season of the present invention.

FIG. 16 is a flow chart of a re-establishment of the temperature increment according to the change in season of the present invention.

DETAILED DESCRIPTION OF THE INVENTION

Figure 6:
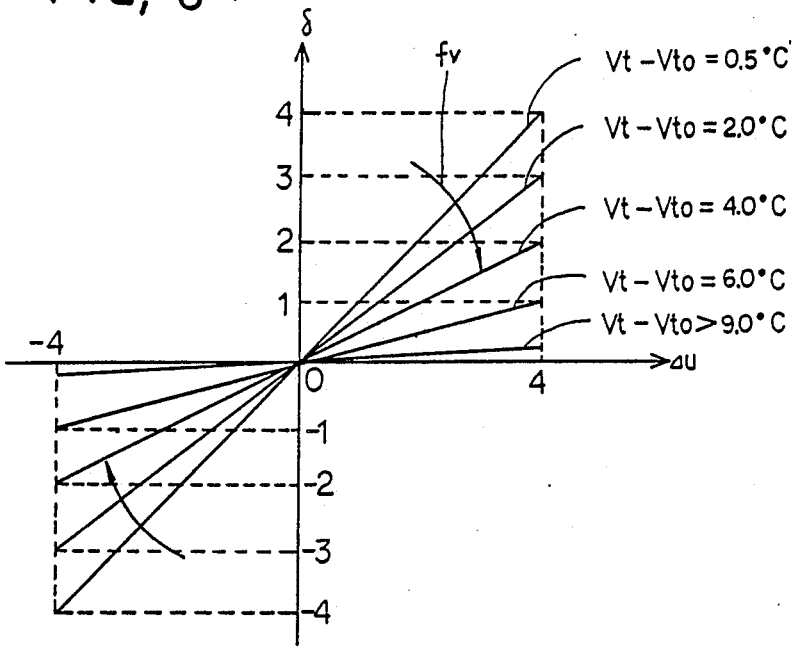
FIG. 6 is a graph showing gradients according to the temperature variation of the inflow and outflow air.

The present invention will now be described in detail with reference to the accompanying drawings as followings.

With respect to the temperature compensating value for the temperature variation of an air flowing into a heating chamber, the temperature compensating value is is proportional to the temperature variation of the air flowing into a heating chamber. If the temperature is raised, the temperature compensating value becomes larger than zero. If the temperature is lowered, the temperature compensating value becomes less than zero.

Secondly, even if the temperature is changed with similar magnitude, the temperature should be compensated differently according to the point in time when the temperature changed. In an initial period of time of operation, the temperature compensating value should be large. According to the time having elapsed, the additional value is decreased, and at the point of time that the operation is completed, the temperature compensating value should become almost zero.

In the above description, the temperature variation of the air flowing into or flowing out of a heating chamber has a certain relationship, as to illustrate this in the graphs, shown in FIGS. 5A and 5B, and expressed by the numerical expression as follows.

$$V = f(U, Q) \tag{1}$$

$$\Delta V = \frac{f}{U} \cdot \Delta U + \frac{f}{Q} \cdot Q \tag{2}$$

Wherein,

U is the temperature of the air flowing into a heating chamber;

V is a temperature of the air flowing out of the heating chamber; and

Q is a heat of capacity of the foods.

Therefore, it can be understood that a predetermined proportional relationship exists between the temperature variations $\Delta U$, $\Delta V$ of the air flowing into or out of the heating chamber. If a temperature U of the inflow air is increased, a temperature V of the outflow air increases more rapidly than during a standard condition, i.e., when the temperature varing portion $\Delta U$ is zero. Consequently, an established temperature increment A is reached rapidly. Accordingly to cause heating period of time to equal the standard condition, the compensated temperature increment $\Delta A$ should be larger than the established temperature increment A. The compensated temperature increment $\Delta A$ should be larger in proportion to the temperature increment $\Delta U$ of the flowed-in. On the contrary, when the temperature U of the flowed-in air drops, the compensated temperature increment $\Delta A$ should be less than the established temperature increment A. This drop in the incoming air represents the effect which the temperature U of the inflow air influences to the temperature variation $\Delta V$ of the outflow air against the variation of time, thereby causing the first coefficient of Formula (2) to be $\partial f/\partial U$. Though the outflow air temperature V according to the temperature variation $\Delta U$ of the air flowed-in varies much because the heat of capacity which the food realizes during the initial period of time of operation, the heating of the food is small. According to the time elapsed, the heat of capacity Q is changed accordingly to the interior temperature of a heating chamber being raised to higher value. The temperature variation ΔU of the air flowed-in causes less influence upon the temperature variation ΔV of the air flowed-out.

FIG. 6 is a graph which shows the experimental temperature variations ΔU, ΔV of the air flowed-in and flowed-out according to the present invention.

Wherein,

δ is a temperature compensating value;

Vt is a temperature of the air flowed-out when a predetermined period of time has elapsed after the heating of the food;

Vto is a temperature of the air flowed-out during an initial period of time $t_0$ for heating the foods;

fv is a gradient according to the elapsed time.

Though the various charateristics including the gradients fv of the graph vary a little according to the magnitude of the heating chamber, basically over the entire period of time needed for heating the foods, the effect and influence that the temperature variation ΔU of the flowed-in air in a direction of an arrow has an the temperature variation ΔV of the flowed-out air is decreased.

Figure 7:
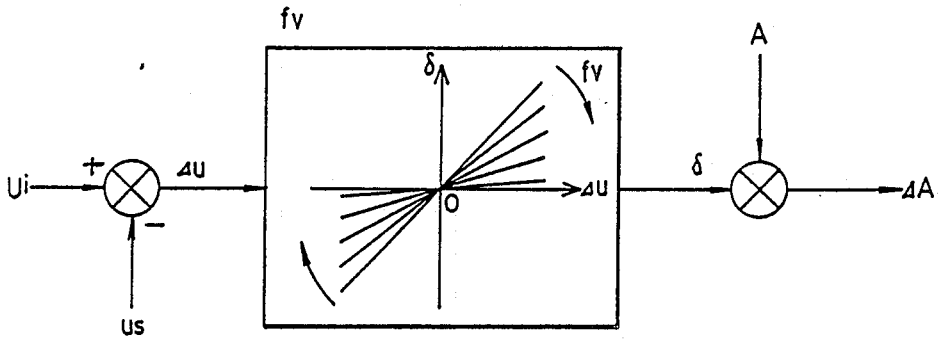
FIG. 7 is a block diagram showing a principle of the present invention.

FIG. 7 illustrates an algorithm with respect to the temperature variation ΔU of the flowed-in air according to the present invention.

Us is a temperature of the flowed-in air, if the temperature compensating value δ is calculated by utilizing the temperature V of the flowed-in air at a time when the temperature of the flowed-in air varies as much as ΔU from first Us to U, the formula is as follows.

$$\delta = fv + \Delta U \quad (3)$$

In the above formula (3), the gradients fv is a decreasing function with respect to the temperature variation Vt−Vto, and its magnitude does not exceed 1.

FIG. 8 is shows examples of the functions of various gradients fv according to the present invention.

When the temperature U of the inflow air is increased at the time of heating the foods, the temperature compensating value becomes a positive value. Since a previously established temperature increment A is to re-establish realize a compensated temperature increment ΔA, the operating period of time of a magnetron becomes longer than usual the increased operating period of time of a magnetron becomes appropriately increased according to the temperature variation ΔU of the flowed-in air. Further, when the temperature U of flowed-in air drops, according to the above logic, the operating period of time of a magnetron is appropriately decreased.

The temperature Us of basic inflow air is established at an initial temperature Uto at an initial time, but if the temperature is varied, and if the temperature increment A is varied into a compensated temperature increment ΔA due to the temperature compensating value δ being raised the temperature re-established at the temperature Ui at a point of time that the variation had been raised.

The principles of the present invention will be explained in detailed below with reference to the accompanying drawings FIG. 9 to FIG. 14.

FIG. 9 is a schematic diagram which illustrates the configuration of a microwave oven according to the present invention. It is constructed with a microcomputer 11 which controls the whole operation of the microwave oven; an electric power source 12 which supplies the operating electric power by the control of the microcomputer 11; a magnetron 13 which generates microwave energy by being actuated according to the output voltage of the electric power source 12; a heating chamber 14 which heats the food by using microwave energy generated from the magnetron 13; a fan 15 which blows air into the air inlet 14A of the heating chamber 14; temperature detecting sensors 16 and 16' which detect the temperature of the air flowing in and out of of air inlet 14A and air outlet 14B, respectively, of the heating chamber 14, and analog/digital converters 17 and 17' which apply the temperature signal of the air detected by the temperature detecting sensors 16 and 16' by converting into a digital signal to be used by the microcomputer 11.

The present invention, as described above, when the cooking is started, operates as shown in the flow chart illustrated in FIG. 10. At first, the microcomputer 11 executes an initial operation, i.e. permits the air temperature of the heating chamber 14 to be uniformed by actuating the fan 15 for a predetermined period of time $t_1$. After a predetermined period of time $t_1$ has elapsed, the microcomputer 11 begins to execute the first stage heating operation. The microcomputer 11 receives and stores the signals of the existing temperatures Uto and Vto of the inflow and outflow air, which are detected by the temperature detecting sensors 16 and 16' disposed at inlet 14A and air outlet 14B of the heating chamber 14. The signals have been converted into the digital signals by analog/digital converters 17 and 17'. The temperature increment A which is established as a basis for the presently existing temperature Vto is established for a temperature increment ΔA. Thereafter, a magnetron 13 is actuated by controlling the electric power supply source 12 The microwave energy which is generated by the operation of the magnetron 13 becomes heats the food contained in the heating chamber 14.

During this process, the microcomputer 11 continuously measures the temperatures Ut and Vt of the air flowed-in and flowed-out since the temperature Ut of inflow air is not varied, if Ut=Us is true, and the temperature Vt of outflow air is raised as much as the temperature increment A established at initial temperature Vto, i.e., compensated temperature increment ΔA, the microcomputer 11 completes the first heating operation.

If Ut=Us is not existed due to the temperature Ut of inflow air being varied during executing of the first stage heating, the temperature variation ΔU is calculated by subtracting the initial temperature Uto from the temperature Ut, and the temperature compensating value δ is calculated by adding the temperature varying value ΔU and the gradient fv corresponding to a point of time when the temperature varied, i.e., calculated-as δ=fv+U. Thereafter the compensated temperature increment ΔA is re-established as ΔA=ΔA+δ. The temperature Ut of the presently existing inflow air is established for a temperature Us of a basic inflow air. The operation as mentioned above is repeatedly executed until the temperature Vt of outflow air is raised as much as the compensated temperature increment Δa, if the temperature Vt of outflow air is raised as much as the compensated increment ΔA, the first stage heating operation is completed.

Thus, when the first stage heating operation of the food contained in the heating chamber 14 is completed, the second stage heating period of time $t_3$ is calculated by multiplying a predetermined value $\alpha$ established according to the kind of food to be heated, with period of time $t_2$ of the first tage heating. The food is heated by continuously actuating the magnetron 13 during the period of time $t_3$. If the second heating period of time $t_3$ has elapsed, the operation of the magnetron 13 and the fan 15 are stopped, thereby causing the heating of the food to be completed.

The present invention as described above will be explained in detail using the following examples of the preferred embodiments when a cabbage is cooked.

COMPARATIVE EXAMPLE 1

When a cabbage was automatically cooked under, the condition that the temperature Ut of inflow air was not varied during the period of time $t_2$ the result as shown in FIG. 11 was obtained.

The temperature increment A of the cabbage was established at 6° C., and the predetermined value $\alpha$ executing the first stage heating was established at 1.

For example, when a cabbage was automatically cooked under the condition that the temperature Uto of the inflow air was at 22° C., the first stage heating operation was completed at 28° C. causing the temperature Vt of the outflow air to increase as much as 6° C. The period of time required for the execution of the first stage heating operation was four minutes. The period of time required for the execution of the second stage heating operation was four minutes.

COMPARATIVE EXAMPLE 2

Beginning the first stage heating under the condition that the temperature Uto of an initial inflow air is at 22° C., after 40 seconds had elapsed, the temperature dropped 2° C. to 20° C. Again, when three minutes had elapsed, the temperature had risen 2° C. to 22° C. When the food were automatically cooked with conventional method, a result as shown in FIG. 12 was obtained.

Since the temperature increment A was applied constantly at 6° C., the period of time $t_2$ executed for first stage heating operation was extended for one minute more than when the temperature variation did not exist therefore, five minutes were also, for the second stage heating operation five minutes were required, thereby requiring a total heating period of ten minutes the cabbage was overcooked and could not be eaten.

EXAMPLE

Under the same condition as the above comparative example 2, when the cabbage was heated by utilizing a gradient fv as in FIG. 14 according to the present invention, the result as shown in FIG. 13 was obtained.

Since beginning the first stage heating, after 40 seconds had elapsed, the temperature Ut of inflow air lowered. The compensated temperature increment ΔA was then established as follows:

$$\begin{aligned} \delta &= (Ut - Uto) \times fv \\ &= (20 - 22) \times 1 \\ &= -2 \end{aligned}$$

-continued $$\begin{aligned} \Delta A &= A + \delta \\ &= 6 + (-2) = 4 \end{aligned}$$

Further, after three minutes were elapsed, the temperature Ut of inflow air was increased by 2° C. and to 22° C. The compensated temperature increment ΔA was then re-established as follows:

$$\delta = (22-20) \times 0.5 = 1$$

$$\Delta A = 4 + 1 = 5$$

Accordingly, the first stage heating operation was completed at 27° C. causing the temperature Vt of outflow air to increase 5° C. over 22° C. The period of time needed to execute for the first stage heating operation, was 3 minutes and 50 seconds. Also, the period of time needed to execute the second stage heating operation was 3 minutes and 50 seconds, thereby making the total heating period of time 7 minutes and 40 seconds. Therefore, this process required about 20 seconds less than when the temperature variation did not exist. The cabbage was cooked correctly.

Meanwhile, FIG. 15 is a block diagram which illustrates an establishment principle of the temperature increment, according to the variation in season, of the present invention.

R is a predetermined basic temperature. U is an ambient temperature. A temperature error E is calculated by subtracting the presently existing ambient temperature U from a basic temperature R. The temperature error E is multiplied by a predetermined temperature increment again, dividing by a predetermined constant value F which is experimentally sought, the compensation value $\alpha l$ is sought. The predetermined temperature increment A is added to said compensation value $\alpha l$. Thereafter, the temperature increment A is re-established.

The re-establishment, according to the variations of season, of the temperature increment utilizing the principle discussed above is illustrated as a flow chart in FIG. 16.

When a cooking start time is actuated by pressing the cooking start button, the microcomputer 11 performs an initial operation as above described with respect to FIG. 10. The temperature of the heating chamber 14 is kept uniformed by actuating a fan 15. Thereafter, when a predetermined period of time $t_1$ has elapsed, the temperature is detected by the temperature detecting sensor 16, and the microcomputer 11 receives and stores the presently existing temperature U of inflow air which is converted into digital signal by the analog/digital converter 17. The temperature increment A is re-established from the presently existing temperature U of inflow air as described in the formula:

$$A \leftarrow A + A \times \frac{R - U}{F}$$

Wherein, F is a predetermined constant value which is sought experimentally.

Thus, once the temperature increment A is re-established, entering the first stage heating of above described FIG. 10 executing the next processes as described above, the automatic cooking can be performed optionally regardless in the variation of ambient temperature according to the change in season.

As described above, according to the present invention, when the temperature of the air flowing into the heating chamber during the first stage heating is varied, the foods is heated by compensating the temperature increment according to the magnitude and the point of time when the temperature is varied so that the cooking process is optimal correctly establishing the heating period of time for the food despite the temperature of inflow air being varied. Entering the first stage heating after the temperature increment has been re-established by using compensating the temperature increment which is established by using a predetermined value according to the difference between the ambient temperature and the basic temperature despite the ambient temperature being varied according to the change in season fauses the cooking to be performed at an optimal level no matter what the season change.

What is claimed is:

1. A method of cooking food in a microwave oven having a heating chamber, a magnetron and a fan and using an automatic cooking control system, comprising the steps of:

(a) actuating the fan to cause an air temperature in an interior of the heating chamber to become uniform;

(b) measuring and storing an initial value for a first temperature of air flowing into the heating chamber, the initial value being stored as a reference temperature value;

(c) measuring and storing an initial value for a second temperature of air flowing out of the heating chamber, the initial value being stored as an incremental value;

(d) actuating the magnetron to heat the interior of the heating chamber for a first period of time;

(e) continuously measuring the first temperature of air flowing into the heating chamber;

(f) continuously measuring the second temperature of air flowing out of the heating chamber;

(g) determining if the first temperature measured in said step (e) is equal to the reference temperature value;

(h) determining if the second temperature measured in said step (f) has increased by a certain amount only when said step (g) has determined that the reference temperature value is equal to the first temperature measured in said step (e), the certain amount is equal to the incremental value; and (i) actuating the magnetron to heat the interior of the heating chamber for a second period of time, thereby completing the automatic cooking of the food in the microwave oven.

2. The method as claimed in claim 1, further comprising the steps of:

(j) determining if the second period of time has elapsed; and (k) terminating the actuation of the magnetron.

3. The method as claimed in claim 1, further comprising the step of:

(j) calculating the second period of time by multiplying the first period of time with a predetermined coefficient, the product of the multiplication being the second period of time.

4. The method as claimed in claim 1, further comprising the step of:

(j) calculating a new incremental value when said step (g) determines that the first temperature measured in said step (e) is not equal to the reference temperature value.

5. The method as claimed in claim 4, wherein said step (j) comprises the steps of:

(k) calculating a difference between the reference temperature value and the first temperature measured in said step (g);

(l) multiplying the difference calculated in said step (k) by a predetermined gradient value to produce an incremental compensation value;

(m) adding the incremental compensation value to the incremental value to produce a sum; and (n) storing the sum produced in said step (m) as a new incremental value.

6. The method as claimed in claim 1, further comprising the step of:

(j) storing the first temperature measured in said step (e) as a new reference temperature value when said step (g) determines that the first temperature measured in said step (e) is not equal to the reference temperature value.

7. A method of cooking food in a microwave oven having a heating chamber, a magnetron and a fan and using an automatic cooking control system, comprising the steps of:

(a) actuating the fan to cause an air temperature in an interior of the heating chamber to become uniform;

(b) measuring and storing an initial value for a first temperature of air flowing into the heating chamber, the initial value being stored as a reference temperature value;

(c) calculating a difference between a predetermined basic temperature and the initial value;

(d) multiplying the difference calculated in said step (c) by a predetermined temperature incremental value to produce a product;

(e) dividing the product of said step (d) by a predetermined constant to produce a compensation value;

(f) adding the compensation value produced in said step (e) with the predetermined temperature incremental value to produce an incremental value;

(g) storing the incremental value produced in said step (f);

(h) actuating the magnetron to heat the interior of the heating chamber for a first period of time;

(i) continuously measuring the first temperature of air flowing into the heating chamber;

(j) continuously measuring the second temperature of air flowing out of the heating chamber;

(k) determining if the first temperature measured in said step (i) is equal to the reference temperature value;

(l) determining if the second temperature measured in said step (j) has increased by a certain amount only when said step (k) has determined that the reference temperature is equal to the first temperature measured in said step (i), the certain amount is equal to the incremental value; and (m) actuating the magnetron to heat the interior of the heating chamber for a second period of time, thereby completing the automatic cooking of the food in the microwave oven.

8. The method as claimed in claim 7, further comprising the steps of:

(n) determining if the second period of time has elapsed; and (o) terminating the actuation of the magnetron.

9. The method as claimed in claim 7, further comprising the step of:

(n) calculating the second period of time by multiplying the first period of time with a predetermined coefficient, the product of the multiplication being the second period of time.

10. The method as claimed in claim 7, further comprising the step of:

(n) calculating a new incremental value when said step (k) determines that the first temperature measured in said step (i) is not equal to the reference temperature value.

11. The method as claimed in claim 10, wherein said step (n) comprises the steps of:

(o) calculating a difference between the reference temperature value and the first temperature measured in said step (k);

(p) multiplying the difference calculated in said step (o) by a predetermined gradient value to produce an incremental compensation value;

(q) adding the incremental compensation value to the incremental value to produce a sum; and (r) storing the sum produced in said step (q) as the new incremental value.

12. The method as claimed in claim 7, further comprising the step of:

(n) storing the first temperature measured in said step (i) as a new reference temperature value when said step (k) determines that the first temperature measured in said step (i) is not equal to the reference temperature value.

* * * * *